US009349359B2

(12) United States Patent
Takata et al.

(10) Patent No.: US 9,349,359 B2
(45) Date of Patent: May 24, 2016

(54) ELECTRONIC KEYBOARD INSTRUMENT

(71) Applicant: ROLAND CORPORATION, Shizuoka (JP)

(72) Inventors: Yukihide Takata, Shizuoka (JP); Yukihiro Morohashi, Shizuoka (JP); Shiro Uno, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 0 days.

(21) Appl. No.: 14/736,279

(22) Filed: Jun. 11, 2015

(65) Prior Publication Data

US 2016/0012809 A1 Jan. 14, 2016

(30) Foreign Application Priority Data

Jul. 8, 2014 (JP) ..... 2014-140247

(51) Int. Cl.
*G10C 3/12* (2006.01)
*G10H 1/34* (2006.01)

(52) U.S. Cl.
CPC ..... *G10H 1/34* (2013.01)

(58) Field of Classification Search
CPC ..... G10H 1/34
See application file for complete search history.

(56) References Cited

U.S. PATENT DOCUMENTS 7,465,863 B2 * 12/2008 Nishida ..... G10C 3/12 84/423 R
7,642,448 B2 * 1/2010 Kato ..... G01D 5/30 84/720
7,692,089 B2 * 4/2010 Nishida ..... G10H 1/32 84/644
7,732,686 B2 * 6/2010 Yamaguchi ..... G10H 1/346 84/236
8,481,841 B2 * 7/2013 Shimoda ..... G10H 1/344 84/719
8,558,095 B2 * 10/2013 Muramatsu ..... G10C 3/12 84/236
8,686,266 B2 * 4/2014 Taniguchi ..... G10H 1/346 84/433
9,006,549 B2 * 4/2015 Suzuki ..... G10H 1/34 84/423 R
9,040,807 B2 * 5/2015 Osuga ..... G10H 1/346 84/744
2013/0180391 A1 * 7/2013 Oba ..... G10F 1/02 84/746
2016/0012809 A1 * 1/2016 Takata ..... G10H 1/34 84/433

FOREIGN PATENT DOCUMENTS

JP 10-240254 9/1998

* cited by examiner

*Primary Examiner* — Robert W Horn
(74) *Attorney, Agent, or Firm* — Jiang Chyun Intellectual Property Office

(57) ABSTRACT

The present invention provides an electronic keyboard instrument capable of strongly supporting an upper panel covering the rear of a key while suppressing shaking of the key and an increase in device size. An electronic keyboard instrument (1) of the present invention includes: a key (3), rotating about a rotating shaft (24); an upper panel (4), covering the rear of the key (3) from above; a chassis (2), disposed in a position to interpose the rear of the key (3) between the chassis (2) and the upper panel (4); a through hole (32*a*), passing through the rear of the key (3) to communicate a side toward the chassis (2) with a side toward the upper panel (4); and a rear guide (25), passing from the chassis (2) through the through hole (32*a*) to extend toward the upper panel (4) and supporting the upper panel (4).

20 Claims, 6 Drawing Sheets

ELECTRONIC KEYBOARD INSTRUMENT

CROSS-REFERENCE TO RELATED APPLICATIONS

This application claims the priority benefit of Japan application serial no. 2014-140247, filed on Jul. 8, 2014. The entirety of the above-mentioned patent application is hereby incorporated by reference herein and made a part of this specification.

BACKGROUND OF THE INVENTION

1. Field of the Invention

The present invention relates to an electronic keyboard instrument, and more particularly, to an electronic keyboard instrument capable of strongly supporting an upper panel covering the rear of a key while suppressing shaking of the key and an increase in device size.

2. Description of Related Art

The following Patent Document 1 describes an electronic keyboard instrument in which the rear of a key is covered by a panel 3. In such electronic keyboard instrument, a fulcrum portion 11*a* and a common base end portion 11*b* are provided on the rear of the key covered by the panel 3, wherein lateral vibration of the key is restricted by the fulcrum portion 11*a*, and the panel 3 is supported in a position of the common base end portion 11*b*.

PRIOR ART LITERATURE

Patent Literature

Patent Literature 1: Japanese Patent Publication No. H10-240254 (see Paragraph 0019).

SUMMARY OF THE INVENTION

Problems to be Solved by the Invention

Nonetheless, in the electronic keyboard instrument described in Patent Literature 1, the fulcrum portion 11*a* and the common base end portion 11*b* are arranged side by side in a depth direction of the device. Hence, there is a problem that the device increases in size in the depth direction.

In addition, the position where the common base end portion 11*b* is arranged, i.e., the position where the panel 3 is supported, is restricted by the fulcrum portion 11*a* that restricts lateral vibration of the key. For that reason, there is a problem that the panel 3 cannot be supported in an arbitrary position, and the panel 3 cannot be strongly supported.

The present invention relates to an electronic keyboard instrument. Particularly, the present invention is intended to provide an electronic keyboard instrument capable of strongly supporting an upper panel covering the rear of a key while suppressing shaking of the key and an increase in device size.

Solution to the Problems and Effect of the Invention

According to an electronic keyboard instrument of a technical solution of the present invention, the following effect is achieved. A chassis is disposed in a position to interpose the rear of a key between the chassis and an upper panel. A through hole communicating a side toward the chassis with a side toward the upper panel passes through the rear of the key.

A rear guide passes from the chassis through the through hole to extend toward the upper panel. Hence, shaking of the key can be suppressed by the rear guide. In addition, the upper panel is supported by the rear guide. That is, the rear guide has both a function of suppressing shaking of the key and a function of supporting the upper panel. Thus, compared to a case where members having these two functions are separately provided, flexibility in the position where the upper panel is supported is improved. Accordingly, the upper panel can be supported in a position where the upper panel is hardly bent, and an increase in device size can be suppressed. As a result, the following effect is obtained. Namely, the upper panel covering the rear of the key can be strongly supported while shaking of the key and an increase in device size are suppressed.

According to an electronic keyboard instrument of another technical solution of the present invention, in addition to the aforementioned effect, the following effect is achieved. A direction in which a plurality of keys are arranged is taken as a width direction. In the rear guide, a bracket extends from a guide body in the width direction to a position where the guide body passes through the through hole. Thus, a gap between the key and the rear guide can be reduced in the width direction. Accordingly, particularly, the following effect is obtained. Namely, the key can be suppressed from shaking in the width direction.

According to an electronic keyboard instrument of another technical solution of the present invention, in addition to the aforementioned effect, the following effect is achieved. A rotating shaft rotatably axially supporting each of the plurality of keys and the rear guide provided with respect to each of the plurality of keys are integrally formed with the chassis. Thus, a positional deviation between the rotating shaft and the rear guide does not occur, and occurrence of malfunction in rotation of the key can be prevented. In addition, the following effect is obtained. Namely, adjacent keys can be arranged with high precision, and collision between the keys can be prevented.

According to an electronic keyboard instrument of another technical solution of the present invention, in addition to the aforementioned effect, the following effect is achieved. The key includes an upper wall, and a pair of side walls hanging down from both edges in a longitudinal direction of the upper wall. A front guide is interposed between the pair of side walls, and the front guide is provided in a position to interpose the rear guide between the front guide and the rotating shaft. Thus, even in the position where the rear guide is interposed between the front guide and the rotating shaft, shaking of the key can be suppressed by the front guide. In addition, the following effect is obtained, namely, it can be prevented that stress is applied to a portion axially supported by the rotating shaft due to shaking of the key and such portion produces strange noise or deforms.

According to an electronic keyboard instrument of another technical solution of the present invention, in addition to the aforementioned effect, the following effect is achieved. A leading end of the rear guide touches a leading end of a support hanging down from the upper panel. That is, the upper panel is supported by the rear guide through the support. Thus, a length of the rear guide extending from the chassis toward the upper panel can be reduced. Accordingly, the following effect is obtained. Namely, rigidity of the rear guide can be improved.

According to an electronic keyboard instrument of another technical solution of the present invention, in addition to the aforementioned effect, the following effect is achieved. An upper surface of an elastic member touches the leading end of the support, and a lower surface of the elastic member touches the leading end of the rear guide. The leading end of the rear guide touches a position on the lower surface of the elastic member to be superimposed with the leading end of the support. Thus, the length of the rear guide extending from the chassis toward the upper panel can be reduced. Accordingly, the following effect is obtained. Namely, rigidity of the rear guide can be improved. In addition, even if the key collides with the rear guide so that the rear guide vibrates due to the collision, the vibration can be absorbed by the elastic member. Accordingly, the following effect is obtained. Namely, occurrence of strange noise due to such vibration can be prevented.

DESCRIPTION OF THE EMBODIMENTS

Figure 1A:
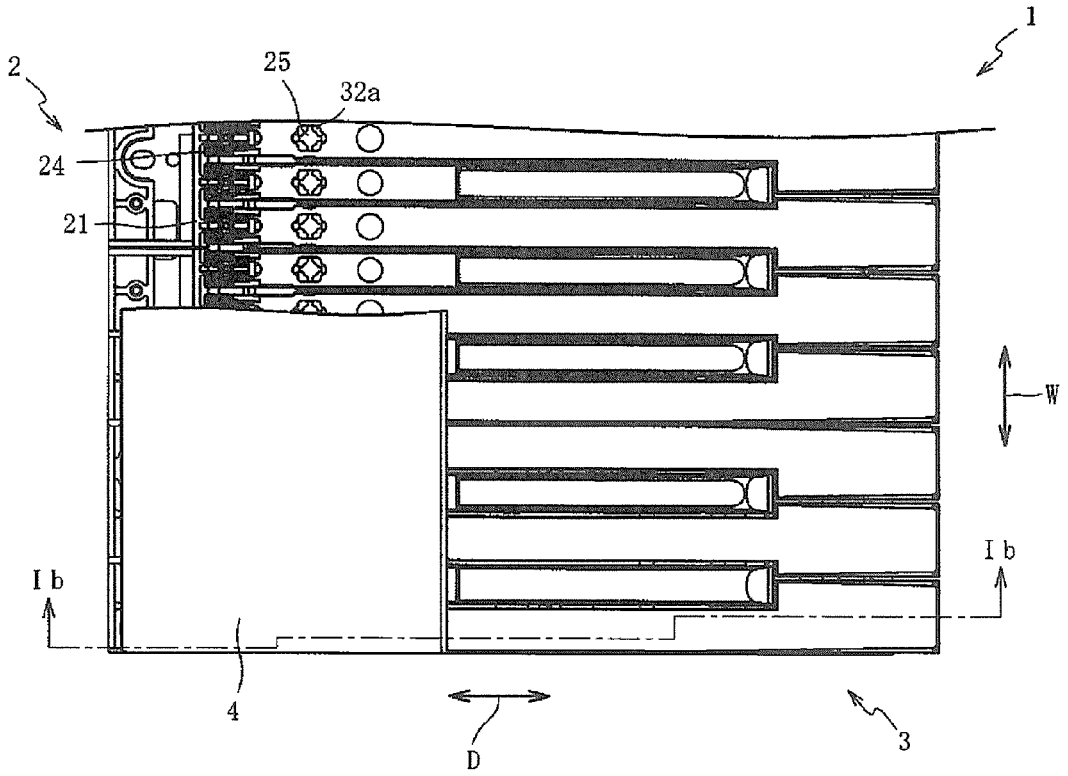
FIG. 1A is a plan view of an electronic keyboard instrument.
Figure 1B:
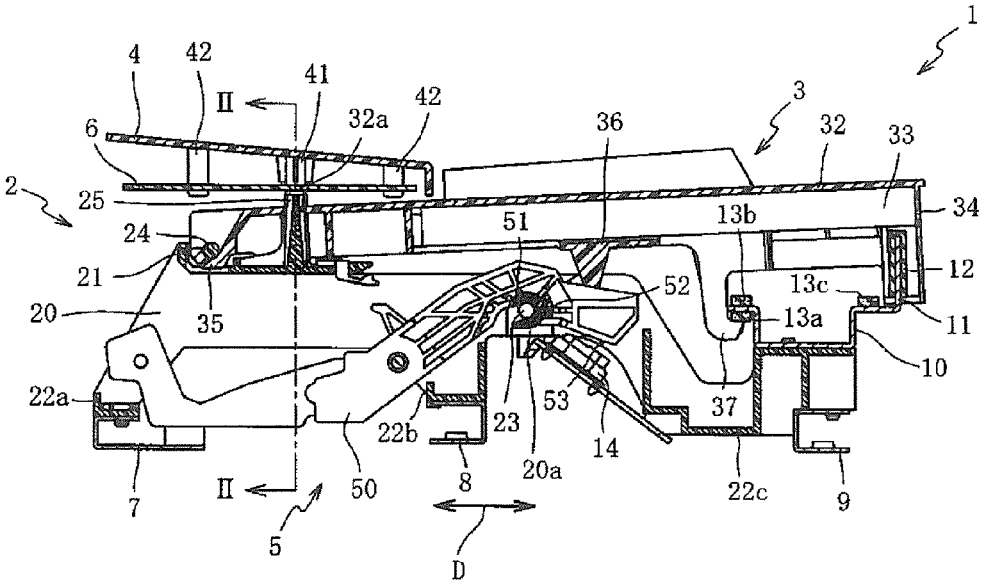
FIG. 1B is a cross-sectional view of the electronic keyboard instrument taken on section line Ib-Ib shown in FIG. 1A.

Preferred embodiments of the present invention are described hereinafter with reference to the accompanying drawings. FIG. 1A is a plan view of an electronic keyboard instrument. FIG. 1B is a cross-sectional view of the electronic keyboard instrument taken on section line Ib-Ib shown in FIG. 1A. Moreover, in the present embodiment, a direction in which a plurality of keys 3 line up is referred to as a width direction W, and a longitudinal direction of the key 3 is referred to as a depth direction D. In addition, in FIG. 1A, the key 3 is shown by only twelve keys in total, including five black keys and seven white keys. The other keys are omitted from the drawing.

An electronic keyboard instrument 1 produces a musical sound by a signal outputted from an electronic circuit (not illustrated) according to an operation of the key 3. Particularly, the electronic keyboard instrument 1 is capable of strongly supporting an upper panel 4 covering the rear of the key 3 while suppressing shaking of the key 3 in the width direction W and an increase in device size. The electronic keyboard instrument 1 is exemplified by an electronic piano, an electronic organ, an electronic keyboard, and a synthesizer, etc.

The electronic keyboard instrument 1 mainly includes: a chassis 2; the key 3, rotatably axially supported by the chassis 2; the upper panel 4, covering the rear of the key 3; and a hammer 5, rotating in response to pressing or release of the key 3. Moreover, in FIG. 1A, only a portion of the upper panel 4 is illustrated.

The chassis 2 forms a framework of the electronic keyboard instrument 1, and is formed of a resin material by blocks in units of a predetermined width. The chassis 2 includes a plurality of block bodies of a chassis body 20, a chassis upper wall 21 formed above the chassis body 20, and chassis bottom walls 22*a* to 22*c* formed on a bottom side of the chassis body 20.

The chassis body 20 is formed below the key 3 and between two adjacent key 3 (two adjacent hammers 5). The chassis upper wall 21 is formed in a position to interpose the rear of the key 3 between the chassis upper wall 21 and the upper panel 4. A key rotating shaft 24 and a rear guide 25 are provided side by side on the chassis upper wall 21 in the depth direction D from the rear of the key 3.

The key rotating shaft 24 rotatably axially supports the key 3 and is formed for each key 3. Here, the key 3 is formed in a substantial "⊐" shape in cross-section with its bottom side opened by an upper wall 32, a pair of side walls 33 hanging down from both edges of the upper wall 32 extending in the depth direction D, and a front wall 34 hanging down from a front end of the upper wall 32. In addition, a hook portion 35 is connected to the rear of the side wall 33. The hook portion 35 of the key 3 is hooked on the key rotating shaft 24. The key 3 is axially supported by the key rotating shaft 24 through the hook portion 35, and rotates about the key rotating shaft 24.

The rear guide 25 suppresses shaking of the key 3 in the width direction W and supports the upper panel 4, and is provided for each key 3. The rear guide 25 extends from the chassis upper wall 21 toward the upper panel 4. The upper wall 32 of the key 3 is located above the chassis upper wall 21, and a through hole 32*a* passes through the upper wall 32 of the key 3. The rear guide 25 passes through the through hole 32*a* to extends toward the upper panel 4. Hence, by the rear guide 25, the key 3 can be suppressed from shaking.

In addition, the key rotating shaft 24 of each key 3 and the rear guide 25 of each key 3 are integrally formed with the chassis upper wall 21 in units of blocks of the chassis body 20. Hence, a positional deviation between the key rotating shaft 24 and the rear guide 25 does not occur, and occurrence of malfunction in rotation of the key 3 can be prevented. In addition, each distance between adjacent keys 3 can be arranged with high precision, and collision between the keys 3 can be prevented.

A leading end of the rear guide 25 touches a leading end of a support 41 passing from the upper panel 4 through a substrate 6 and hanging down. In other words, the rear guide 25 supports the upper panel 4 through the support 41. Moreover, various switches provided on the upper panel 4 or electronic circuits connected to a liquid-crystal panel are installed on the substrate 6. Cylindrical bosses 42 having the support 41 interposed therebetween in the depth direction D and having an internal thread formed inside hang down from the upper panel 4. The substrate 6 is screwed to the upper panel 4 through the boss 42. Here, the rear guide 25 is described in detail with reference to FIG. 2.

Figure 2:
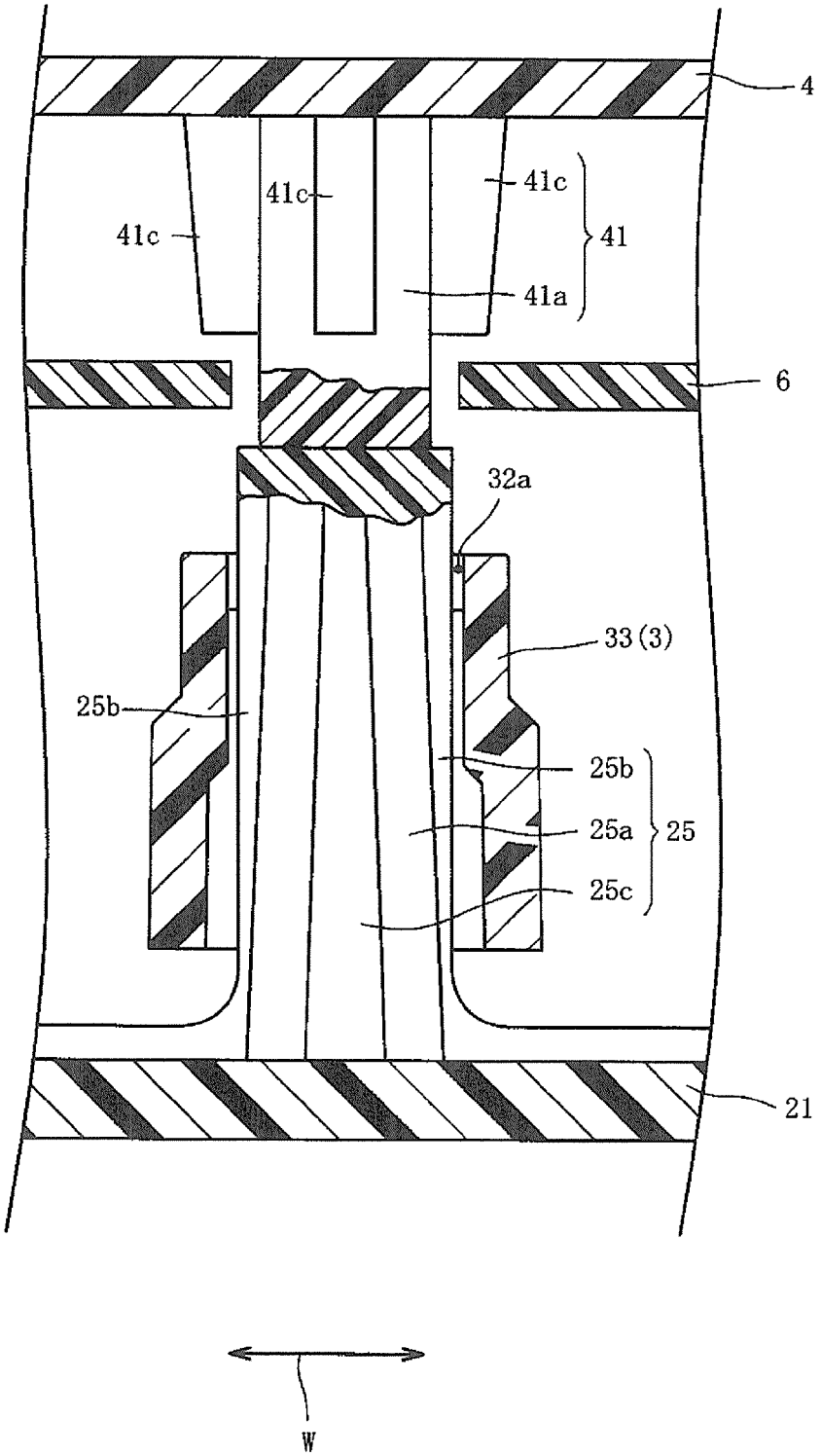
FIG. 2 is a partial cross-sectional view of a rear guide taken on section line II-II in FIG. 1B.

FIG. 2 is a partial cross-sectional view of the rear guide 25 taken on section line II-II in FIG. 1B. Moreover, in FIG. 2, to facilitate understanding of the appearance of the rear guide 25, a portion of the rear guide 25 and the support 41 is viewed in cross-section.

The rear guide 25 includes a cylindrical guide body 25*a*, a first bracket 25*b* extending from the guide body 25*a* to both sides in the width direction W, and a second bracket 25*c* extending from the guide body 25*a* to both sides in the depth direction D (see FIG. 1B).

In the rear guide 25, since the first bracket 25*b* is provided on the guide body 25*a*, a gap between an inner surface of the side wall 33 and the first bracket 25*b* is smaller than a gap between the inner surface of the side wall 33 and the guide body 25*a*. Thus, shaking of the key 3 in the width direction W can be suppressed by the first bracket 25*b*. In addition, a length of the through hole 32*a* in the width direction W is equal to a length between the inner surfaces of the pair of side walls 33. Hence, the gap between the inner surface of the side wall 33 and the first bracket 25*b* extends in a height direction (up-down direction in FIG. 2) over a predetermined distance, and shaking of the key 3 in the width direction W can be more reliably suppressed. Furthermore, rigidity of the rear guide 25 is increased by the first bracket 25*b* and the second bracket 25*c*. Moreover, a lubricant such as grease is applied between the rear guide 25 and the inner surface of the side wall 33, and the key 3 easily slides along the through hole 32*a*.

The support 41 includes a cylindrical support body 41*a* passing from the upper panel 4 through the substrate 6 and extending downward, and a bracket 41*c* extending from the support body 41*a* to both sides in the width direction W and to both sides in the depth direction D. Since the bracket 41*c* is provided on the support 41, rigidity of the support 41 is increased.

In the support 41, an end surface of the support body 41*a* touches an end surface of the rear guide 25. That is, the rear guide 25 supports the upper panel 4 through the support 41. The support 41 may also be omitted and the rear guide 25 may be extended to the upper panel 4 so that the upper panel 4 is directly supported by the rear guide 25. However, in this case, the rear guide 25 is lengthened and its rigidity is reduced. In addition, it is necessary for the rear guide 25 to pass through both the key 3 and the substrate 6, and positioning becomes difficult.

With respect to this, in the present embodiment, the rear guide 25 touches the support 41 (end surface of the support body 41*a*), and supports the upper panel 4 through the support 41. Thus, the length of the rear guide 25 can be reduced, and rigidity of the rear guide 25 is easily maintained. In addition, since it is not necessary for the rear guide 25 to pass through both the key 3 and the substrate 6, positioning is also easy.

In this way, the rear guide 25 has both a function of suppressing the key 3 from shaking in the width direction W and a function of supporting the upper panel 4. Thus, compared to a case where members having such functions are separately provided, flexibility in the position where the upper panel 4 is supported is improved. Accordingly, while the key 3 is suppressed from shaking in the width direction W, the upper panel 4 can be supported by the rear guide 25 in a position where the upper panel 4 is hardly bent, and an increase in device size can be suppressed. Moreover, similarly to a later-described front guide 11, the rear guide 25 may also be covered by a cover composed of an elastic member such as rubber or elastomer, etc.

The explanation is continued by referring back to FIG. 1B. Base members 7 to 9 made of metal and formed in a shape of a letter "コ" in cross-section are fixed below the chassis bottom walls 22*a* to 22*c*. Rigidity of the chassis 2 is increased by the base members 7 to 9. In addition, since the base members 8 and 9 are composed of the same member, a number of members can be decreased. Furthermore, the base members 8 and 9 are fixed back-to-back. The reason is explained with reference to FIGS. 3A to 3D.

Figure 3B:
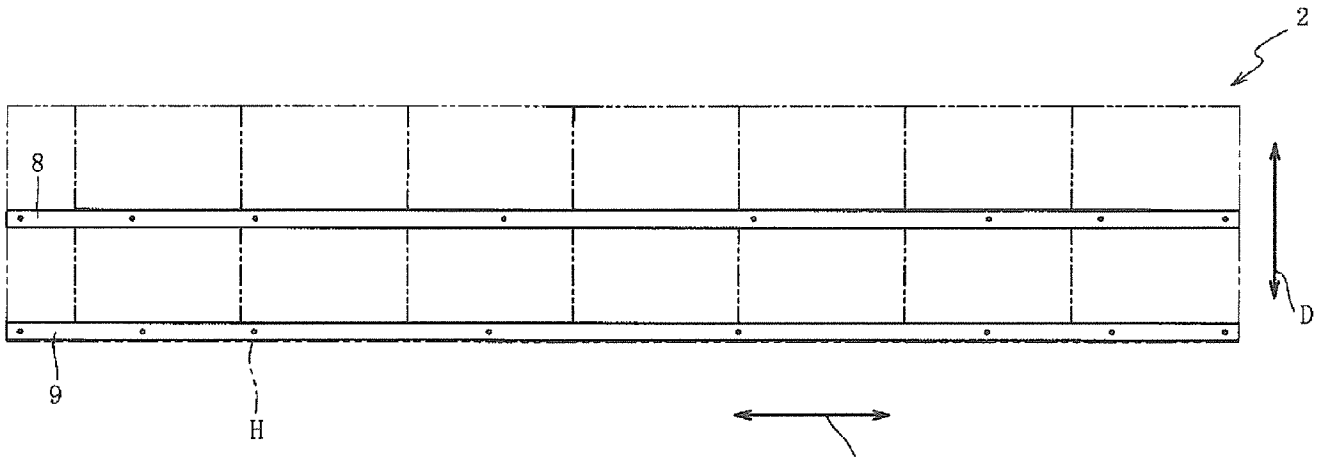
FIG. 3B is a bottom view of the electronic keyboard instrument as viewed in the direction of an arrow IIIa2 shown in FIG. 3A.
Figure 3A:
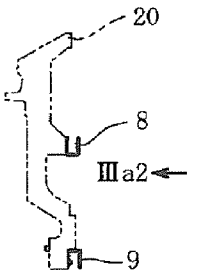
FIG. 3A is a side view of a base member of the present embodiment fixed to a chassis body.

FIGS. 3A and 3B illustrate the present embodiment and illustrate a state in which the base members 8 and 9 are fixed back-to-back. FIG. 3A is a side view of the chassis body 20 and the base members 8 and 9. FIG. 3B is a bottom view of the electronic keyboard instrument 1 as viewed in the direction of the arrow IIIa2 shown in FIG. 3A.

Figure 3D:
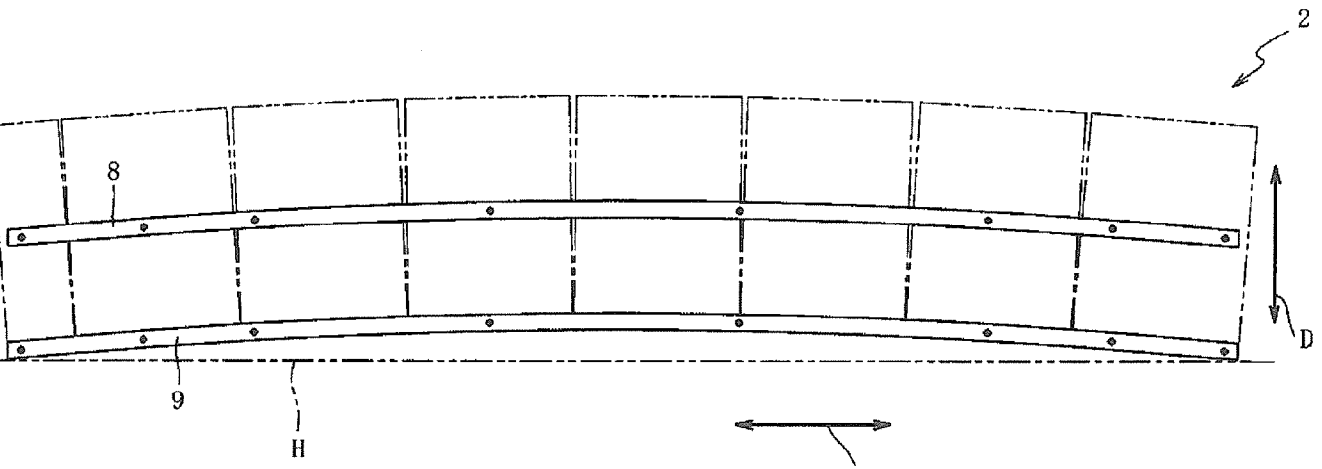
FIG. 3D is a bottom view of the electronic keyboard instrument as viewed in the direction of an arrow IIIb2 shown in FIG. 3C.
Figure 3C:
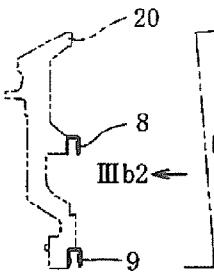
FIG. 3C is a side view of the base member fixed to the chassis body in an orientation different from that of the present embodiment.

FIGS. 3C and 3D illustrate a state in which the base member 8 shown in FIGS. 3A and 3B is fixed in an opposite orientation. FIG. 3C is a side view of the chassis body 20 and the base members 8 and 9. FIG. 3D is a bottom view of the electronic keyboard instrument 1 as viewed in the direction of the arrow IIIb2 shown in FIG. 3C.

The base members 8 and 9 are connected to a plurality of chassis bodies 20, and are elongated over the entire length of the electronic keyboard instrument 1 in the width direction W in order to increase rigidity of the chassis 2. Hence, the base members 8 and 9 may be formed by being bent in a fixed direction during press working. Hence, if the base members 8 and 9 formed in a bent manner are fixed to the chassis body 20 in the same orientation as each other as shown in FIGS. 3C and 3D, the entirety of the chassis 2 may be bent following the base members 8 and 9. That is, the entirety of the chassis 2 may be bent rearward (to the upper side in FIG. 3D) with respect to a horizontal line H.

Accordingly, in the present embodiment, as shown in FIGS. 3A and 3B, the base members 8 and 9 are fixed back-to-back. Accordingly, the base members 8 and 9 act to cancel out the bending of each other. Thus, bending of the entire chassis 2 as shown in FIGS. 3C and 3D can be prevented. In other words, as shown in FIGS. 3A and 3B, the entirety of the chassis 2 can be parallel to the horizontal line H.

Moreover, in FIGS. 3A and 3B, the case where the base members 8 and 9 are fixed back-to-back has been described. However. the base members 8 and 9 may also be fixed in an opposite manner (i.e., a manner in which opening sides having a shape of the letter "コ" in cross-section face each other). In this case, the same effect as that of the case where the base members 8 and 9 are fixed back-to-back is obtained.

The explanation is continued by referring back to FIG. 1B. A metal article 10 made of metal is fixed on the chassis bottom wall 22*c* on a side opposite the base member 9. The front guide 11 is provided in front (right side in FIG. 1B) of the metal article 10.

The front guide 11 suppresses the key 3 from shaking in the width direction W, and extends from a position below the key 3 to a position between the pair of side walls 33 hanging down from both ends of the key 3. Hence, the key 3 can be suppressed from shaking in the width direction W. In addition, since the front guide 11 is covered by a cover 12 composed of an elastic member such as rubber or elastomer, etc., an impact in a case where the side wall 33 of the key 3 collides with the front guide 11 can be buffered. In addition, a lubricant such as grease is applied on the cover 12, and sliding between the cover 12 and the key 3 becomes easier.

Furthermore, the front guide 11 is provided in a position to interpose the rear guide 25 between the front guide 11 and the key rotating shaft 24 in the depth direction D. That is, in the electronic keyboard instrument 1, the key 3 is suppressed from shaking in the width direction W by both the rear guide 25 and the front guide 11 in front of the key rotating shaft 24. Thus, stress applied to the hook portion 35 of the key 3 axially supported by the key rotating shaft 24 because of shaking of the key 3 is alleviated, and it can be prevented that the hook portion 35 of the key 3 produces strange noise or deforms due to shaking of the key 3.

Cushion materials 13*a*, 13*b* and 13*c* are stuck to a flange portion of the metal article 10 connected to the front guide 11 and a flange portion of the metal article 10 located on the opposite side. In addition, the cushion material 13*c* is stuck to an end portion of the metal article 10 opposite the one connected to the front guide 11. The cushion materials 13*a*, 13*b* and 13*c* function as a buffer material or a sound absorbing material, and are formed of felt or urethane foam, etc. On the other hand, a stopper member 37 having an L shape in a side view is formed on the side wall 33 of the key 3. When the key 3 is pressed, the side wall 33 of the key 3 collides with the cushion materials 13*b* and 13*c*; when the key 3 is released, the stopper member 37 of the key 3 collides with the cushion material 13*a*. Hence, by means of the cushion materials 13*a*, 13*b* and 13*c*, an impact with the key 3 can be absorbed, and sound generated at the time of collision can be reduced.

The key 3 is disposed above the chassis body 20 and formed of a resin material. A connecting protrusion 36 having a substantially pointed shape is provided facing the hammer 5 at a central portion of the side wall 33 of the key 3 in the depth direction D. The connecting protrusion 36 connects (contacts) the key 3 with the hammer 5. That is, in a key-pressing operation, the key 3 is provided with a predetermined touch weight by a weight of the hammer 5; in a key-releasing operation, the key 3 is lifted upward by the weight of the hammer 5.

The hammer 5 is provided in a row in the width direction W for each key 3, and is configured as a structure formed by insert molding a metal member in a resin material. The hammer 5 is for providing the same touch weight as that of an acoustic piano by rotation in response to pressing or release of the key 3. The hammer 5 mainly includes a hammer body 50 and a bearing 51.

The hammer body 50 is a portion extending to both sides in the depth direction D across the bearing 51. The bearing 51 is a portion connected to the hammer body 50 and axially supported by a hammer rotating shaft 23, and is formed in a C shape in cross-section. The hammer rotating shaft 23 axially supports the hammer 5 and projects from a subchassis 20*a* of the chassis body 20. The bearing 51 of the hammer 5 is fitted to the hammer rotating shaft 23, and the hammer 5 rotates about the hammer rotating shaft 23. In addition, a lateral vibration restricting portion 52 is provided on the hammer body 50 in front (right side in FIG. 1B) of the bearing 51. Here, the lateral vibration restricting portion 52 is described with reference to FIGS. 4A and 4B.

Figure 4A:
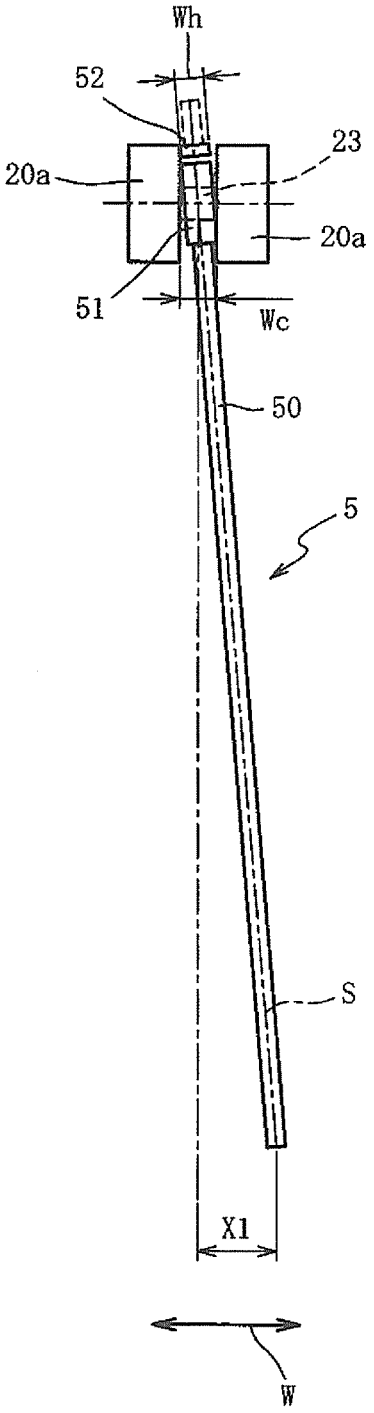
FIG. 4A is a plan view of a hammer of the present embodiment including a lateral vibration restricting portion.
Figure 4B:
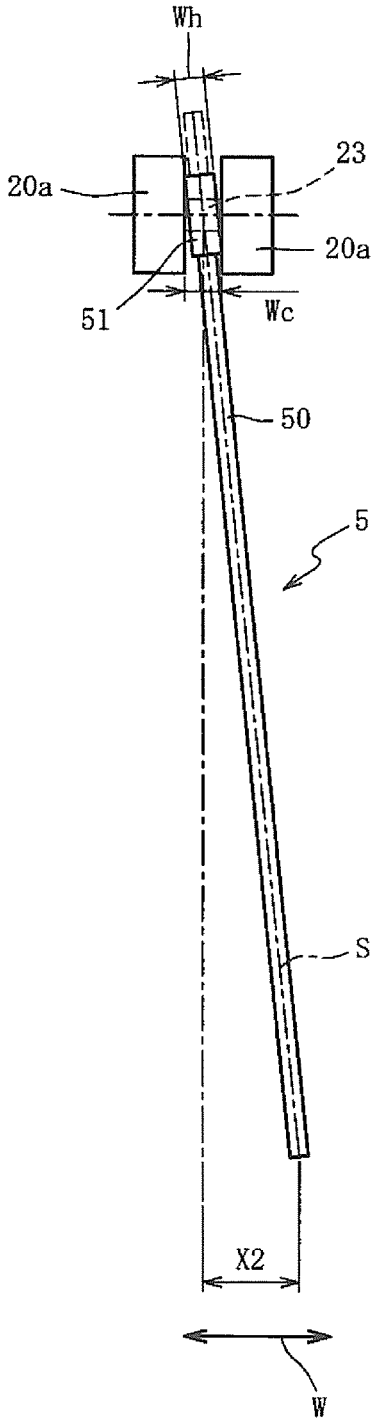
FIG. 4B is a plan view of the hammer not including the lateral vibration restricting portion 52.

FIG. 4A is a plan view of the hammer 5 of the present embodiment including the lateral vibration restricting portion 52. FIG. 4B is a plan view of the hammer 5 not including the lateral vibration restricting portion 52.

As shown in FIG. 4A, the lateral vibration restricting portion 52 is provided at a portion in front (above, in FIG. 4A) of the bearing 51 across a center line S of the hammer 5 in a longitudinal direction (depth direction D). The bearing 51 of the hammer 5 and the lateral vibration restricting portion 52 are configured to have a wall thickness Wh thicker than the hammer body 50. The bearing 51 of the hammer 5 is fitted to the hammer rotating shaft 23 (see FIG. 1B) bridging between the subchassis 20*a* opposed to each other at an interval Wc. The bearing 51 and the lateral vibration restricting portion 52 are located between inner surfaces of opposing subchassis 20*a*, and rotate about the hammer rotating shaft 23 while sliding on the inner surfaces of the subchassis 20*a*. Moreover, a lubricant such as grease is applied between the bearing 51 and the inner surface of the subchassis 20*a* and between the lateral vibration restricting portion 52 and the inner surface of the subchassis 20*a*, and sliding becomes easier.

In this way, if the lateral vibration restricting portion 52 is provided, compared to the case where the lateral vibration restricting portion 52 is omitted as shown in FIG. 4B, the lateral vibration restricting portion 52 collides with the subchassis 20*a* and the hammer 5 can be suppressed from shaking in the width direction W. In other words, in the rear (lower side in FIGS. 4A and 4B) of the hammer 5, the degree of shaking of the hammer 5 in the width direction W can be reduced (X2>X1). Accordingly, the hammer 5 can be prevented from colliding with the other members.

In addition, a diameter of the bearing 51 may also be increased, or a component equivalent to the lateral vibration restricting portion 52 may also be provided all around the bearing 51. However, in such case, frictional resistance with the inner surface of the subchassis 20*a* is increased and the feeling in pressing the key 3 is hindered. With respect to this, the lateral vibration restricting portion 52 of the present embodiment is provided at only a portion in front (above, in FIG. 4A) of the bearing 51. Thus, while the degree of shaking of the hammer 5 in the width direction W can be reduced, the feeling in pressing the key 3 can be maintained in a good state.

Moreover, in the present embodiment, the case where the lateral vibration restricting portion 52 is provided at only a portion in front (above, in FIG. 4A) of the bearing 51 has been described. However, the lateral vibration restricting portion 52 may also be provided on an opposite side from the lateral vibration restricting portion 52 across the hammer rotating shaft 23, and in such case, the same effect as above is obtained.

The explanation is continued by referring back to FIG. 1B. A switch protrusion 53 projects downward on a surface of the hammer body 50 opposite the position in contact with the connecting protrusion 36 of the key 3. On the other hand, a switch 14 is provided in a position on the chassis body 20 opposed to the switch protrusion 53.

When the hammer 5 rotates about the hammer rotating shaft 23 in response to pressing of the key 3, the switch 14 is switched ON by the switch protrusion 53 of the hammer 5; in response to release of the key 3, the switch 14 is switched OFF. Accordingly, pressing or release of the key 3 can be detected.

As described above, in the electronic keyboard instrument 1 of the present embodiment, the upper panel 4 covering the rear of the key 3 is supported by the rear guide 25 passing from the chassis upper wall 21 through the through hole 32*a* of the key 3. That is, the rear guide 25 has both the function of suppressing the key 3 from shaking in the width direction W and the function of supporting the upper panel 4. Thus, compared to the case where members having such functions are separately provided, flexibility in the position where the upper panel 4 is supported is improved. Accordingly, while the key 3 is suppressed from shaking in the width direction W, the upper panel 4 can be supported by the rear guide 25 in a position where the upper panel 4 is hardly bent, and an increase in size of the electronic keyboard instrument 1 can be suppressed.

Figure 5C:
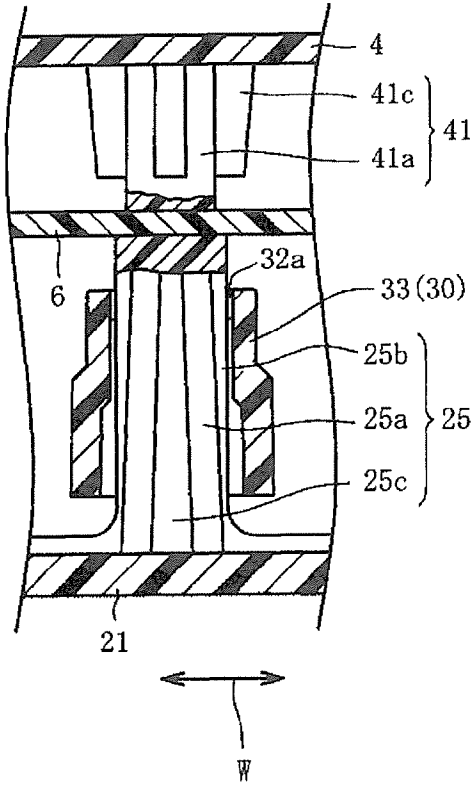
FIGS. 5A to 5C are views respectively corresponding to FIG. 2, and are partial cross-sectional views for illustrating a first variant to a third variant of a method for supporting an upper panel by the rear guide.
Figure 5B:
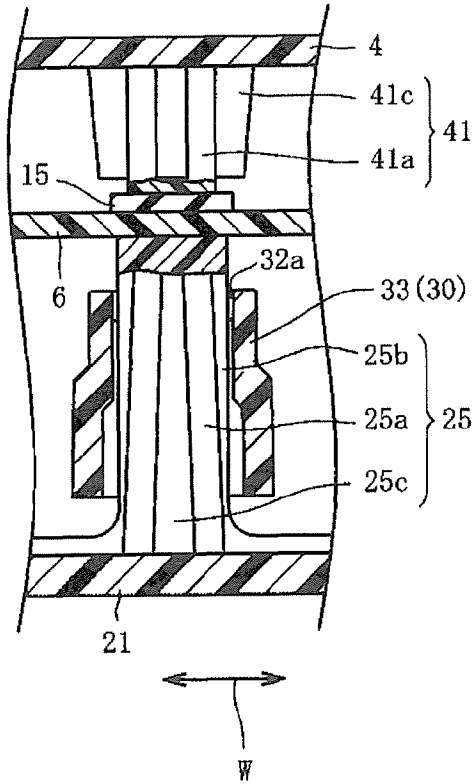
Figure 5A:
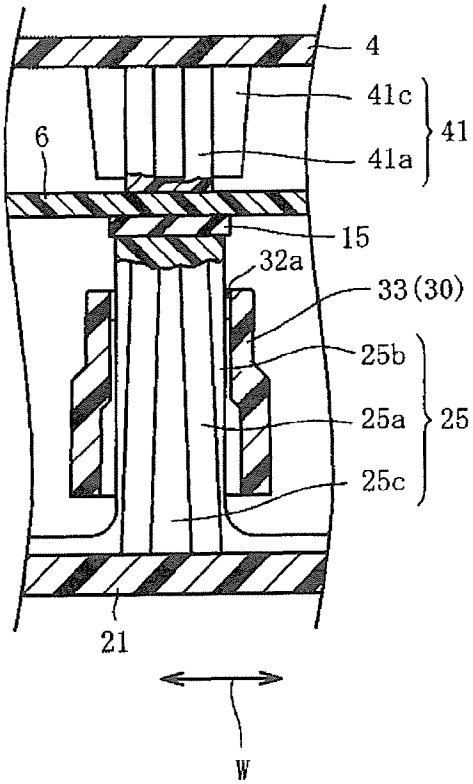
Figure 6C:
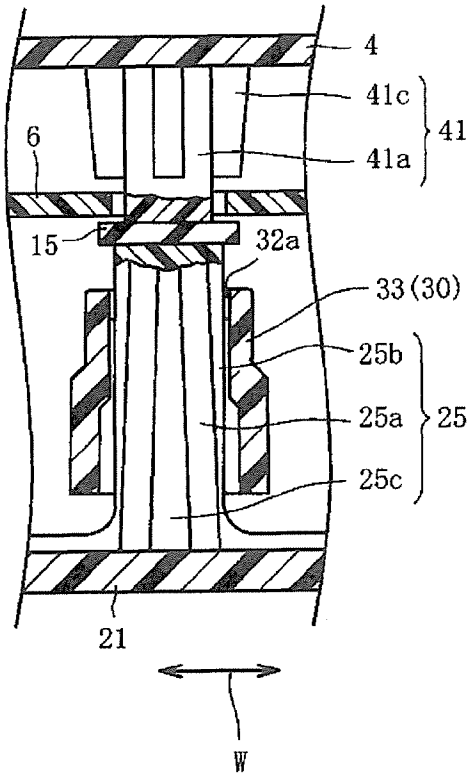
FIGS. 6A to 6C are views respectively corresponding to FIG. 2, and are partial cross-sectional views for illustrating a fourth variant to a sixth variant of the method for supporting the upper panel by the rear guide.
Figure 6B:
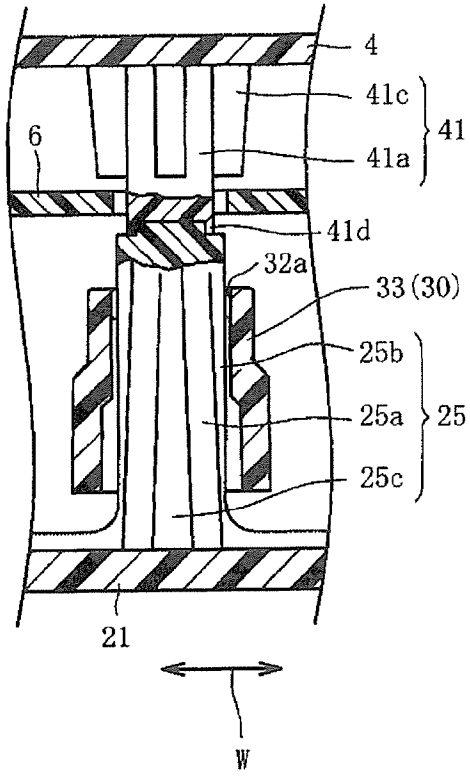
Figure 6A:
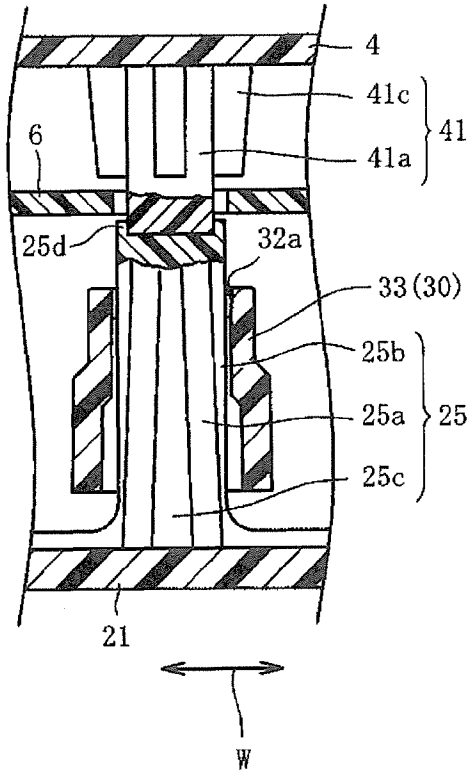

Next, variants of the aforementioned method of supporting the upper panel 4 by the rear guide 25 are explained with reference to FIGS. 5A to 5C and FIGS. 6A to 6C. FIGS. 5A to 5C and FIGS. 6A to 6C are respectively corresponding to FIG. 2, wherein FIG. 5A illustrates the first variant, FIG. 5B illustrates the second variant, FIG. 5C illustrates the third variant, FIG. 6A illustrates the fourth variant, FIG. 6B illustrates the fifth variant, and FIG. 6C illustrates the sixth variant.

As shown in FIG. 5A, the first variant is a method as follows. The substrate 6 and a vibration-proof material 15 are interposed between the leading end of the support 41 and the leading end of the rear guide 25, and the upper panel 4 is thereby supported by the rear guide 25. The vibration-proof material 15 is, e.g., formed of an elastic body composed of an elastic member such as rubber or elastomer, etc. The leading end of the rear guide 25 is in a position to be superimposed with the leading end of the support 41 through the vibration-proof material 15 and the substrate 6. That is, neither the rear guide 25 nor the support 41 passes through the substrate 6. Moreover, methods for fixing the vibration-proof material 15 include by use of an adhesive or by use of a double-sided tape, etc. In addition, a preferred installation is as follows. The vibration-proof material 15 is fixed to only either of the rear guide 25 and the substrate 6 by attachment or adhesion, so as to freely slide to a certain extent on the other one.

In this method, since the upper panel 4 is supported by the rear guide 25 through the substrate 6 and the vibration-proof material 15, the same effect as that of the above embodiment is achieved. In addition, in the first variant, it is not necessary to provide a through hole in the substrate 6, so that positioning is easy. Furthermore, since the vibration-proof material 15 is disposed between the rear guide 25 and the support 41, even if the key 3 collides with the rear guide 25, vibration thereof can be absorbed by the vibration-proof material 15. Thus, it can be prevented that, due to such collision, supporting positions of the rear guide 25 and the support 41 deviate, or strange noise occurs.

As shown in FIG. 5B, the second variant is as follows. The vibration-proof material 15 is provided between the support 41 and the substrate 6. In such case, the same effect as that of the first variant is obtained. Moreover, the vibration-proof material 15 may also be provided both between the rear guide 25 and the substrate 6 and between the support 41 and the substrate 6. In such case, vibration caused by collision between the key 3 and the rear guide 25 can be more reliably absorbed.

As shown in FIG. 5C, the third variant is a method as follows. The vibration-proof material 15 is omitted. The substrate 6 is interposed between the leading end of the support 41 and the leading end of the rear guide 25, and the upper panel 4 is thereby supported by the rear guide 25. In such case, it is not necessary to provide a through hole in the substrate 6, so that positioning is easier than in the above embodiments.

As shown in FIG. 6A, the fourth variant is as follows. An annular protrusion 25*d* is provided on the leading end of the rear guide 25. That is, due to the annular protrusion 25*d*, a concave portion in which the leading end of the support 41 is inserted is formed on the leading end of the rear guide 25. Accordingly, even if the key 3 collides with the rear guide 25, vibration thereof can be absorbed by the annular protrusion 25*d*. Thus, it can be prevented that, due to such collision, the supporting positions of the rear guide 25 and the support 41 deviate.

As shown in FIG. 6B, the fifth variant is as follows. In contrast to FIG. 6A, an annular protrusion 41*d* is provided on the leading end of the support 41. That is, due to the annular protrusion 41*d*, a concave portion in which the leading end of the rear guide 25 is inserted is formed on the leading end of the support 41. Accordingly, even if the key 3 collides with the rear guide 25, vibration thereof can be absorbed by the annular protrusion 41*d*. Thus, it can be prevented that, due to such collision, the supporting positions of the rear guide 25 and the support 41 deviate.

As shown in FIG. 6C, the sixth variant is as follows. An upper surface of the vibration-proof material 15 touches the leading end of the support 41, and a lower surface of the vibration-proof material 15 touches the leading end of the rear guide 25. The leading end of the rear guide 25 touches a position on the lower surface of the vibration-proof material 15 to be superimposed with the leading end of the support 41. Thus, the length of the rear guide 25 extending from the chassis upper wall 21 toward the upper panel 4 can be reduced. Accordingly, rigidity of the rear guide 25 can be improved. In addition, even if the key 3 collides with the rear guide 25 so that the rear guide 25 vibrates due to the collision, the vibration can be absorbed by the vibration-proof material 15. Accordingly, occurrence of strange noise caused by such vibration can be prevented.

The above illustrates the present invention on the basis of the embodiments. However, it is easily understood that the prevent invention is not limited to any of the aforementioned embodiments, and various modifications or alterations may be made without departing from the spirit of the present invention.

In the above embodiments, the case where the rear guide 25 is erected from the chassis upper wall 21 has been described. However, the present invention is not limited thereto. For example, another new chassis for erecting the rear guide 25 may also be provided below the chassis upper wall 21, or an existing chassis may also be used. In such case, since the chassis having the key rotating shaft 24 provided thereon and the chassis having the rear guide 25 provided thereon can be separated from each other, a load applied to the chassis can be alleviated.

In the above embodiments, the case where the first bracket 25*b* and the second bracket 25*c* are provided on the rear guide 25 has been described. However, the present invention is not limited thereto. The first bracket 25*b* and the second bracket 25*c* are not necessarily provided, or at least one of the first bracket 25*b* and the second bracket 25*c* may be provided. In addition, the bracket may also be provided in a direction other than the width direction W and the depth direction D. In such case, with respect to the direction in which the bracket extends, shaking of the key can be effectively prevented.

In the above embodiments, as shown in FIG. 2, the case where the support 41 passes through the substrate 6 has been described. However, the present invention is not limited thereto. The rear guide 25 may also be configured to pass through the substrate 6. In such case, the same effect as that of the above embodiments is obtained.

In the above embodiments, the case where the leading end of the rear guide 25 touches the leading end of the support 41 has been described. However, for example, both may also be fixed by a double-sided tape, etc. In such case, even if the key 3 collides with the rear guide 25, it can be prevented that, due to such collision, the supporting positions of the rear guide 25 and the support 41 deviate, and strange noise occurs.

In the above embodiments, as shown in FIG. 1B, the case where the support 41 is provided in a position interposed between the bosses 42 in the depth direction D has been described. However, the present invention is not limited thereto. For example, the support 41 may also be provided in the position of the boss 42 on the front side (right side in FIG. 1B) so that the upper panel 4 is supported by the rear guide 25 in such position. In addition, a screw screwed to the boss 42 may be a countersunk screw, so that a lower side of the countersunk screw is supported by the rear guide 25. In this case, the substrate 6 can be fixed to the upper panel 4 through the boss 42, and the upper panel 4 can be supported by the rear guide 25 through the boss 42. That is, the support 41 can be omitted.

In the above embodiments, the case where the rear guide 25 is provide for each key 3 has been described. However, the present invention is not limited thereto. For example, between the function of preventing shaking of the key 3 and the function of supporting the upper panel 4, a part of the rear guides 25 may have only the function of preventing shaking of the key 3. In addition, it is not necessary that each of the rear guides 25 be arranged in a row in the width direction W as shown in FIG. 1A. For example, the position where the rear guide 25 is disposed may also be provided to be shifted in the depth direction D by the black key and the white key. In addition, in a position where the upper panel 4 is easily bent, the upper panel 4 may also be supported by two or more rear guides 25, or the upper panel 4 may also be supported by a rear guide thicker than the other rear guides. That is, the rear guide 25 can be provided in a position so that a chance of the upper panel 4 being bent is reduced as much as possible.

What is claimed is:

1. An electronic keyboard instrument, comprising a key, rotating about a rotating shaft;

an upper panel, covering a rear of the key from above;

a chassis, disposed in a position to interpose the rear of the key between the chassis and the upper panel;

a through hole, passing through the rear of the key to communicate a side toward the chassis with a side toward the upper panel; and a rear guide, passing from the chassis through the through hole to extend toward the upper panel and supporting the upper panel.

2. The electronic keyboard instrument according to claim 1, wherein a plurality of the keys are arranged in a width direction; and the rear guide comprises a guide body, and a first bracket extending from the guide body in the width direction to a position where the guide body passes through the through hole.

3. The electronic keyboard instrument according to claim 2, wherein the key comprises an upper wall, and a pair of side walls hanging down from both edges in a longitudinal direction of the upper wall; and in the rear guide, the first bracket is provided on the guide body, and a gap between an inner surface of the side wall and the first bracket is smaller than a gap between the inner surface of the side wall and the guide body.

4. The electronic keyboard instrument according to claim 3, wherein the rear guide further comprises a second bracket extending from the guide body to both sides in a depth direction of the electronic keyboard instrument.

5. The electronic keyboard instrument according to claim 2, wherein the chassis comprises a plurality of rotating shafts rotatably axially supporting each of the plurality of keys;

a plurality of the rear guides are provided with respect to each of the plurality of keys; and the plurality of rotating shafts and the plurality of rear guides are integrally formed with the chassis.

6. The electronic keyboard instrument according to claim 1, wherein the key comprises an upper wall, and a pair of side walls hanging down from both edges in a longitudinal direction of the upper wall; and the electronic keyboard instrument comprises a front guide, the front guide being in a position to interpose the rear guide between the front guide and the rotating shaft and extending from a position below the key to a position between the pair of side walls.

7. The electronic keyboard instrument according to claim 1, comprising a support hanging down from the upper panel, wherein a leading end of the rear guide touches a leading end of the support.

8. The electronic keyboard instrument according to claim 7, further comprising an annular protrusion provided on the leading end of the rear guide.

9. The electronic keyboard instrument according to claim 7, further comprising an annular protrusion provided on the leading end of the support.

10. The electronic keyboard instrument according to claim 7, wherein the support comprises a support body, and a bracket extending from the support body to both sides in a width direction and both sides in a depth direction.

11. The electronic keyboard instrument according to claim 1, comprising a support, hanging down from the upper panel; and an elastic member, having an upper surface touching a leading end of the support and having a lower surface opposite the upper surface and touching a leading end of the rear guide, wherein the leading end of the rear guide touches a position on the lower surface of the elastic member to be superimposed with the leading end of the support.

12. The electronic keyboard instrument according to claim 1, comprising a substrate, provided between the upper panel and the key; and a support, hanging down from the upper panel, wherein a leading end of the rear guide touches a position on a lower surface of the substrate to be superimposed with a leading end of the support.

13. The electronic keyboard instrument according to claim 12, further comprising an elastic member having an upper surface touching the leading end of the support and having a lower surface opposite the upper surface and touching the substrate.

14. The electronic keyboard instrument according to claim 12, further comprising an elastic member having an upper surface touching the substrate and having a lower surface opposite the upper surface and touching the leading end of the rear guide.

15. The electronic keyboard instrument according to claim 12, wherein the support comprises a support body, and a bracket extending from the support body to both sides in a width direction and both sides in a depth direction.

16. The electronic keyboard instrument according to claim 1, further comprising a hammer rotating in response to pressing or release of the key, wherein the hammer comprises a hammer body axially supported by a hammer rotating shaft projecting from subchassis, the subchassis being opposed to each other at an interval in a width direction of the chassis;

a bearing of the hammer bridges the opposing subchassis and is fitted to the hammer rotating shaft;

a lateral vibration restricting portion is provided on the hammer body, the lateral vibration restricting portion being provided at a portion of the bearing and configured to have a wall thickness thicker than the hammer body in the width direction;

the bearing and the lateral vibration restricting portion are located between inner surfaces of the opposing subchassis, rotating about the hammer rotating shaft while sliding on the inner surfaces of the opposing subchassis, so as to suppress the hammer from shaking in the width direction.

17. The electronic keyboard instrument according to claim 16, wherein the lateral vibration restricting portion is provided at a portion above the bearing in a height direction of the electronic keyboard instrument.

18. The electronic keyboard instrument according to claim 16, wherein the key comprises an upper wall, and a pair of side walls hanging down from both edges in a longitudinal direction of the upper wall; and a connecting protrusion is provided facing the hammer in a depth direction of the side wall of the key, the connecting protrusion contacting the key and the hammer.

19. The electronic keyboard instrument according to claim 18, wherein a switch protrusion projects downward on a surface of the hammer body opposite the position in contact with the connecting protrusion, and a switch is provided in a position on the chassis opposed to the switch protrusion.

20. The electronic keyboard instrument according to claim 1, further comprising base members connected to a plurality of the chassis, elongated over an entire length of the electronic keyboard instrument in a width direction and fixed back-to-back.

* * * * *